US010608360B2

(12) United States Patent
Ikeda

(10) Patent No.: US 10,608,360 B2
(45) Date of Patent: Mar. 31, 2020

(54) CIRCUIT BOARD-MOUNTED ELECTRICAL CONNECTOR

(71) Applicant: Hirose Electric Co., Ltd., Shinagawa-ku, Tokyo (JP)

(72) Inventor: Ryota Ikeda, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/445,087

(22) Filed: Jun. 18, 2019

(65) Prior Publication Data

US 2019/0393635 A1 Dec. 26, 2019

(30) Foreign Application Priority Data

Jun. 20, 2018 (JP) ..... 2018-116654

(51) Int. Cl.
*H01R 12/79* (2011.01)
*H01R 13/40* (2006.01)
*H01R 12/77* (2011.01)

(52) U.S. Cl.
CPC ..... *H01R 12/79* (2013.01); *H01R 12/778* (2013.01); *H01R 13/40* (2013.01)

(58) Field of Classification Search
CPC ..... G02B 6/3897; H01R 12/78; H01R 12/79; H01R 13/40
See application file for complete search history.

(56) References Cited

U.S. PATENT DOCUMENTS 6,797,882 B1 * 9/2004 Crane, Jr. ..... G02F 1/13452 174/551
9,065,227 B2 * 6/2015 Ashibu ..... H01R 12/79
9,184,522 B1 * 11/2015 Savoy ..... H01R 12/79
9,343,832 B2 * 5/2016 Aoki ..... H01R 12/772
9,350,120 B2 * 5/2016 Aoki ..... H01R 13/6581

FOREIGN PATENT DOCUMENTS

JP H10-214659 A 8/1998

* cited by examiner

*Primary Examiner* — Briggitte R. Hammond
(74) *Attorney, Agent, or Firm* — Procopio, Cory, Hargreaves & Savitch LLP

(57) ABSTRACT

A housing 10 comprises connector-side transmission-permitting portions 10A that permit the transmission of wave signals in the connector-height direction, a circuit board B comprises board-side transmission-permitting portions B1 that permit the transmission of wave signals in the connector-height direction at locations corresponding to the above-mentioned connector-side transmission-permitting portions 10A when the electrical connector 1 is mounted, and, when a counterpart connector component C is inserted all the way to a normal position, the transmission of wave signals permitted in the process of insertion of the above-mentioned counterpart connector component C becomes blocked by the above-mentioned counterpart connector component C, or alternatively, the transmission of wave signals blocked by the above-mentioned counterpart connector component C in the process of insertion of said counterpart connector component C becomes permissible at the locations of the above-mentioned connector-side transmission-permitting portions 10A and the above-mentioned board-side transmission-permitting portions B1.

5 Claims, 4 Drawing Sheets

CIRCUIT BOARD-MOUNTED ELECTRICAL CONNECTOR

CROSS-REFERENCE TO RELATED APPLICATIONS

This application claims priority to Japanese Patent Application No. 2018-116654, filed Jun. 20, 2018, the contents of which are incorporated herein by reference.

BACKGROUND

Technical Field

The present invention relates to a circuit board-mounted electrical connector comprising a circuit board and an electrical connector which is mounted on a mounting face of said circuit board and to which a counterpart connector component is removably connected.

Related Art

In an electrical connector which is mounted on a mounting face of a circuit board and to which a counterpart connector component is removably connected such that a front-to-rear direction parallel to said mounting face is the direction of insertion and extraction, said counterpart connector component and the connector are electrically connected by inserting the counterpart connector component all the way to its normal position in the direction of insertion of said counterpart connector component. Therefore, when the counterpart connector component is inserted, it is desirable for operators to be able to detect and confirm whether said counterpart connector component has been inserted all the way to the normal position.

Connectors configured to detect the state of insertion of the counterpart connector component, in other words, the presence or absence of insertion up to the normal position, include, for example, the connector of Patent Document 1. In the connector of Patent Document 1, a rearwardly open insertion chamber is formed in a housing retaining multiple terminals in array form, and a distal end portion of a flat conductor serving as a counterpart connector component (FPC) is adapted to be received within the above-mentioned insertion chamber from the rear. In a top wall located above said insertion chamber, at locations proximal to both ends in the terminal array direction (direction coinciding with the width direction of the FPC), the above-mentioned housing has formed therein peepholes that pass through the above-mentioned top wall in the vertical direction. Said peepholes are formed at locations corresponding to the two corner portions at the distal end of the FPC inserted all the way to the normal position.

In the connector of Patent Document 1 provided with the above-described peepholes, when the FPC is inserted into the above-mentioned insertion chamber, an operator can confirm that the FPC has been inserted all the way to the normal position by looking through the above-mentioned peepholes from above and visually observing both corner portions at the distal end of the FPC.

[Patent Document 1]

Japanese Unexamined Published Patent Application No. H10-214659.

SUMMARY

Problems to be Solved

However, in the case of the connector of Patent Document 1, in order to confirm whether the FPC has been inserted in the normal position, the operator had to perform the operation of visual observation by looking through the peepholes from above for each individual connector, which made the confirmation operations quite burdensome for the operator and required considerable time. Furthermore, if such visual observation was done from a slanted vantage point, situations could occur in which the result of confirmation was incorrect despite having performed a confirmation operation.

In view of such circumstances, it is an object of the present invention to provide a circuit board-mounted electrical connector, in which operations intended to confirm whether a counterpart connector component has been inserted all the way to the normal position can be performed in a simple and precise manner. Further, it is an object to provide a circuit board-mounted electrical connector that makes it possible to simply and precisely carry out the operation of confirming whether a counterpart connector component has been inserted all the way to the normal position.

Technical Solution

The inventive circuit board-mounted electrical connector is a circuit board-mounted electrical connector comprising a circuit board and an electrical connector which is mounted on a mounting face of said circuit board and to which a counterpart connector component is removably connected such that a front-to-rear direction parallel to said mounting face is the direction of insertion and extraction, wherein the above-mentioned electrical connector comprises a housing, which has formed therein a receiving portion that receives, from the rear, the above-mentioned counterpart connector component whose width direction is a direction parallel to the above-mentioned mounting face and perpendicular to the front-to-rear direction, and terminals, which are retained in place in said housing and which have formed therein contact portions contacting the above-mentioned counterpart connector component inserted into the above-mentioned receiving portion and also have formed therein connection portions connected to the mounting face of the above-mentioned circuit board.

Such a circuit board-mounted electrical connector, according to the present invention, is characterized by the fact that, within the range of the above-mentioned receiving portion in a plane parallel to the above-mentioned mounting face, the above-mentioned housing comprises connector-side transmission-permitting portions that permit the transmission of wave signals in the connector-height direction perpendicular to the above-mentioned mounting face; the above-mentioned circuit board has board-side transmission-permitting portions that permit the transmission of wave signals in the connector-height direction at locations corresponding to the above-mentioned connector-side transmission-permitting portions when the above-mentioned electrical connector is mounted; and, when the above-mentioned counterpart connector component is inserted all the way to the normal position, the transmission of wave signals permitted in the process of insertion of the above-mentioned counterpart connector component becomes blocked by the above-mentioned counterpart connector component, or alternatively, the transmission of wave signals blocked by said counterpart connector component in the process of insertion of the above-mentioned counterpart connector component becomes permissible at the locations of the above-mentioned connector-side transmission-permitting portions and the above-mentioned board-side transmission-permitting portions.

In the present invention, the connector-side transmission-permitting portions formed in the housing of the electrical connector and the board-side transmission-permitting portions formed in the circuit board (referred to collectively as "transmission-permitting portions" whenever necessary) are positioned in alignment with each other when the electrical connector is mounted on the mounting face of the circuit board. Consequently, as described below, emitting wave signals used for the confirmation of the state of insertion of the counterpart connector component from one side of the circuit board-mounted electrical connector to the other side thereof in the connector-height direction at the locations of the transmission-permitting portions makes it possible to confirm whether the counterpart connector component has been inserted all the way to the normal position.

For example, in a configuration in which the counterpart connector component is absent at the locations of the transmission-permitting portions when said counterpart connector component is inserted all the way to the normal position, the transmission of wave signals is permitted and the transmitted wave signals are detected on the above-mentioned other side when the counterpart connector component is in the normal position. On the other hand, when the counterpart connector component has not been brought to the normal position even though said counterpart connector component has been inserted, no wave signals are detected on the above-mentioned other side because said counterpart connector component is present at the locations of the transmission-permitting portions and the transmission of wave signals is blocked by said counterpart connector component.

In addition, in a configuration in which the counterpart connector component is present at the locations of the transmission-permitting portions when said counterpart connector component is inserted all the way to the normal position, the transmission of wave signals is blocked by the counterpart connector component and no wave signals are detected on the above-mentioned other side when said counterpart connector component is in the normal position. On the other hand, when the counterpart connector component has not been brought to the normal position even though said counterpart connector component has been inserted, said counterpart connector component is absent at the locations of the transmission-permitting portions, the transmission of wave signals is permitted, and the transmitted wave signals are detected on the above-mentioned other side.

As used herein, the term "wave signals" refers to signals whose transmission is impeded by insulating resin materials. Suggested examples of such signals include infrared light, UV light, visible light, and other optical signals, as well as ultrasonic waves and other acoustic wave signals.

In the present invention, the above-mentioned connector-side transmission-permitting portions may be formed as openings passing through the above-mentioned housing in the connector-height direction and the above-mentioned board-side transmission-permitting portions may be formed as openings passing through the above-mentioned circuit board in the connector-height direction. Forming the transmission-permitting portions as openings in this manner allows for said transmission-permitting portions to be readily formed using simple shapes.

In the present invention, the above-mentioned connector-side transmission-permitting portions and the above-mentioned board-side transmission-permitting portions may be formed at locations corresponding to the ends of the above-mentioned counterpart connector component in the width direction. When the orientation of the counterpart connector component within the receiving portion is tilted such that the front end edges of said counterpart connector component at the two ends of said counterpart connector component in the width direction are offset relative to each other in the front-to-rear direction, the amount of offset of the ends in the front-to-rear direction relative to the normal orientation (non-tilted orientation) is larger in comparison with the intermediate portion of the counterpart connector component in the width direction. Due to the fact that in the present invention the transmission-permitting portions are formed at locations corresponding to the ends of the above-mentioned counterpart connector component in the width direction, it is easy to detect that the counterpart connector component has not been inserted all the way to the normal position.

In the present invention, in a state in which a flat conductor serving as the above-mentioned counterpart connector component, which has formed therein ear portions protruding in the above-mentioned width direction, has been inserted all the way to the normal position, the above-mentioned connector-side transmission-permitting portions and the above-mentioned board-side transmission-permitting portions may be formed to be at the same locations as the above-mentioned ear portions, or alternatively, may be formed to be at locations to the rear of said ear portions. In general, ear portions intended for engagement with the connector are provided predominantly at the ends of the flat conductor in the width direction. In accordance with the present invention, the ear portions of said flat conductor can be used as detection targets for the determination of the state of insertion of said flat conductor.

In the present invention, the above-mentioned board-side transmission-permitting portions may be made larger than said connector-side transmission-permitting portions when viewed in the connector-height direction in a range that includes the above-mentioned connector-side transmission-permitting portions. In this manner, if the board-side transmission-permitting portions are made larger than the connector-side transmission-permitting portions, transmission through the board-side transmission-permitting portions becomes more reliable because this makes it possible to avoid situations where some wave signals transmitted through the connector-side transmission-permitting portions are blocked by the circuit board when wave signals are emitted from said connector-side transmission-permitting portions in the connector-height direction.

Technical Effect

In the present invention, as described above, the connector-side transmission-permitting portions formed in the housing of the electrical connector and the board-side transmission-permitting portions formed in the circuit board are positioned in alignment with each other when the electrical connector is mounted on the mounting face of the circuit board. Consequently, emitting wave signals used for the confirmation of the state of insertion of the counterpart connector component from one side of the circuit board-mounted electrical connector to the other side thereof in the connector-height direction at the locations of the transmission-permitting portions makes it possible to determine whether the counterpart connector component has been inserted all the way to the normal position, depending on whether said wave signals have been transmitted through the transmission-permitting portions and detected on the above-mentioned other side. As a result, the operator no longer needs to confirm the state of insertion of the counterpart connector component by looking at each individual connector, as was conventionally done, and the state of insertion of the counterpart connector component can be confirmed in an extremely easy manner. In addition, the accuracy of the results of insertion state confirmation can be improved because there is no risk that the operator may perform visual observation from a slanted vantage point, as was the case in the past.

BRIEF DESCRIPTION OF DRAWINGS

FIGS. 4(A) and 4(B) illustrate cross-sectional view illustrating a cross-section of the electrical connector for flat conductors taken in a plane perpendicular to the terminal array direction and an insertion state detection device, wherein FIG. 4(A) illustrates the process of flat conductor insertion and FIG. 4(B) illustrates the state of complete insertion of the flat conductor.

DETAILED DESCRIPTION

An embodiment of the present invention is described below with reference to the accompanying drawings.

Figure 1:
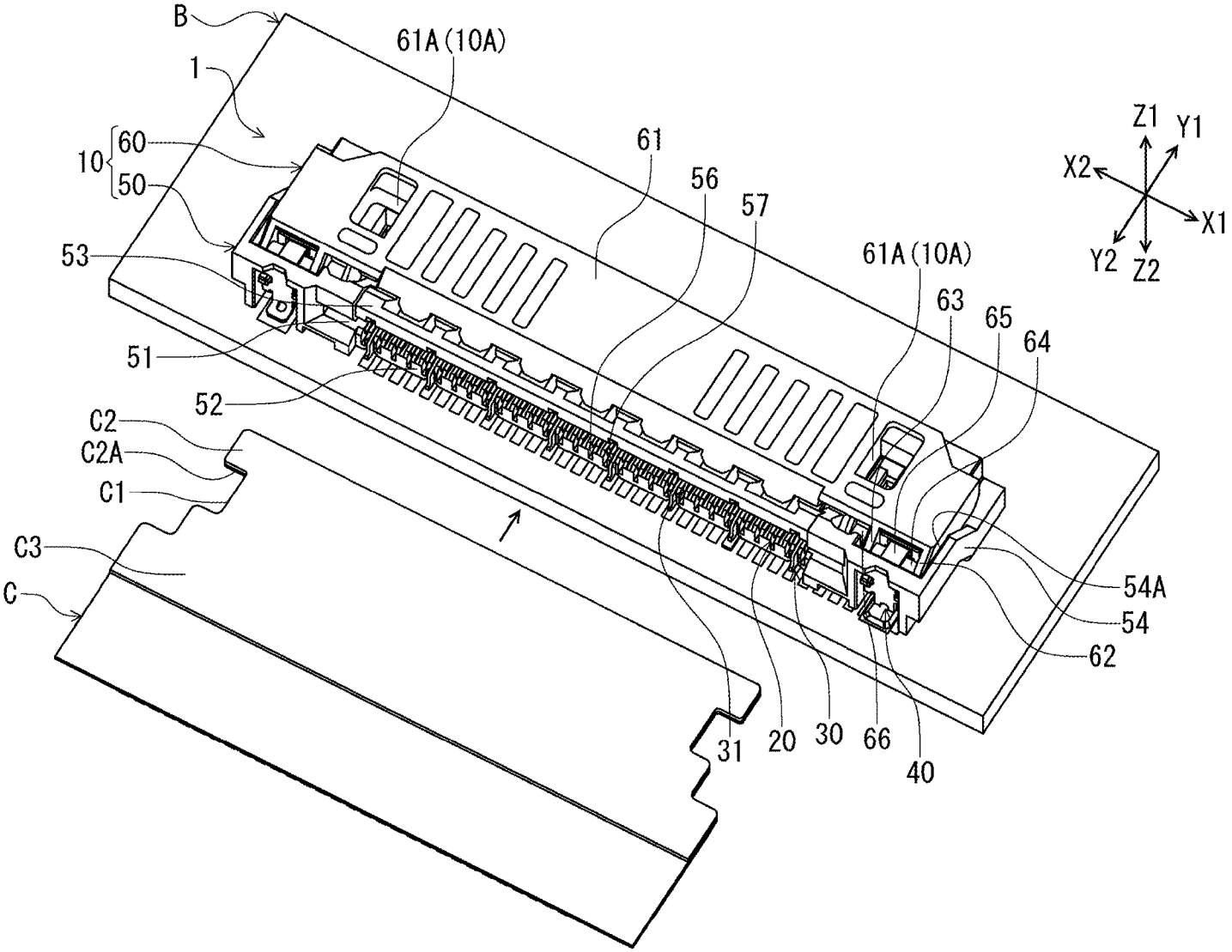
FIG. 1 illustrates a perspective view illustrating a circuit board-mounted electrical connector according to an embodiment of the present invention and a flat conductor in a state immediately prior to the insertion of the flat conductor.
Figure 2:
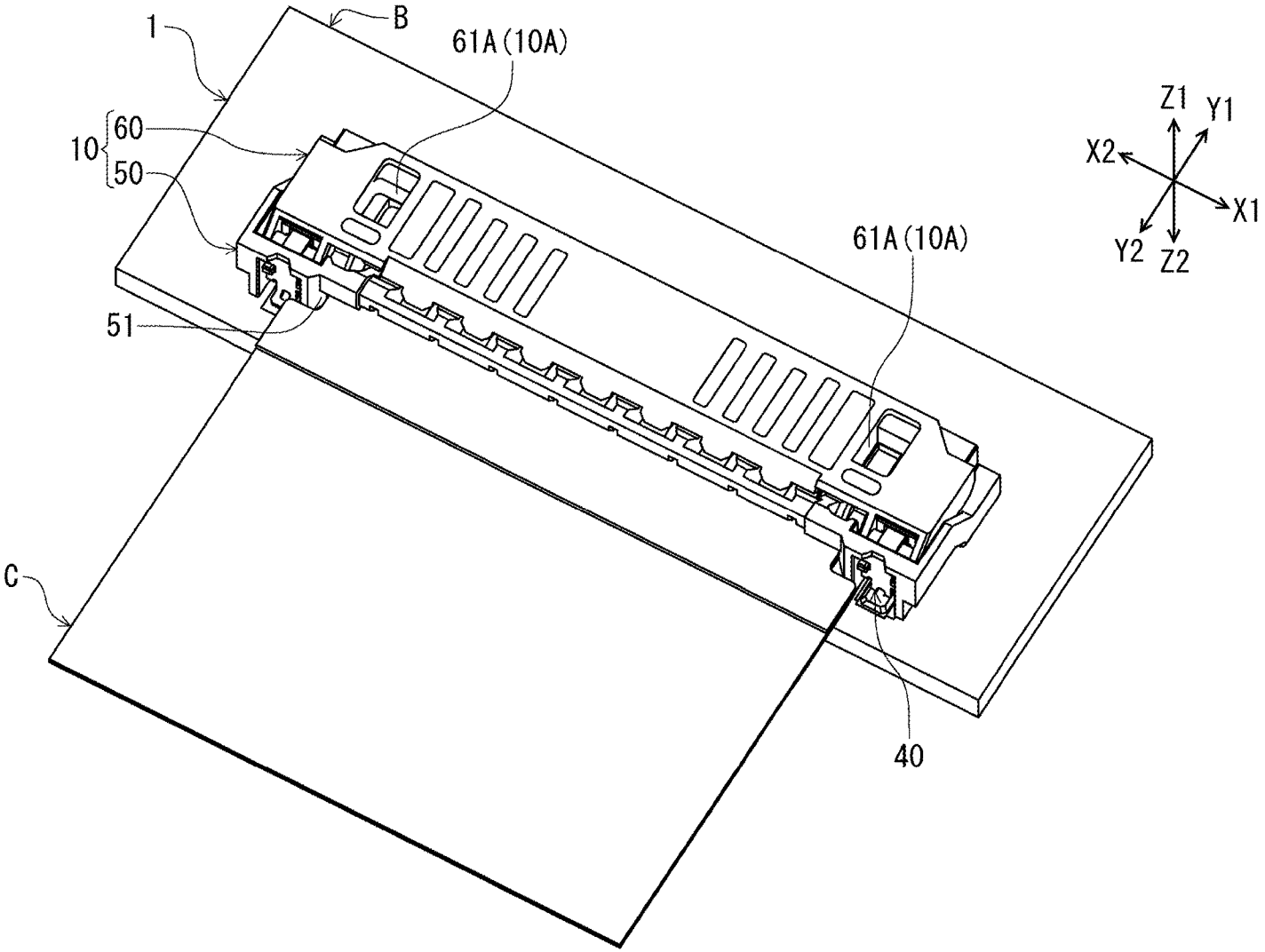
FIG. 2 illustrates a perspective view illustrating the circuit board-mounted electrical connector of FIG. 1 and the flat conductor in a state of complete insertion of the flat conductor.
Figure 3:
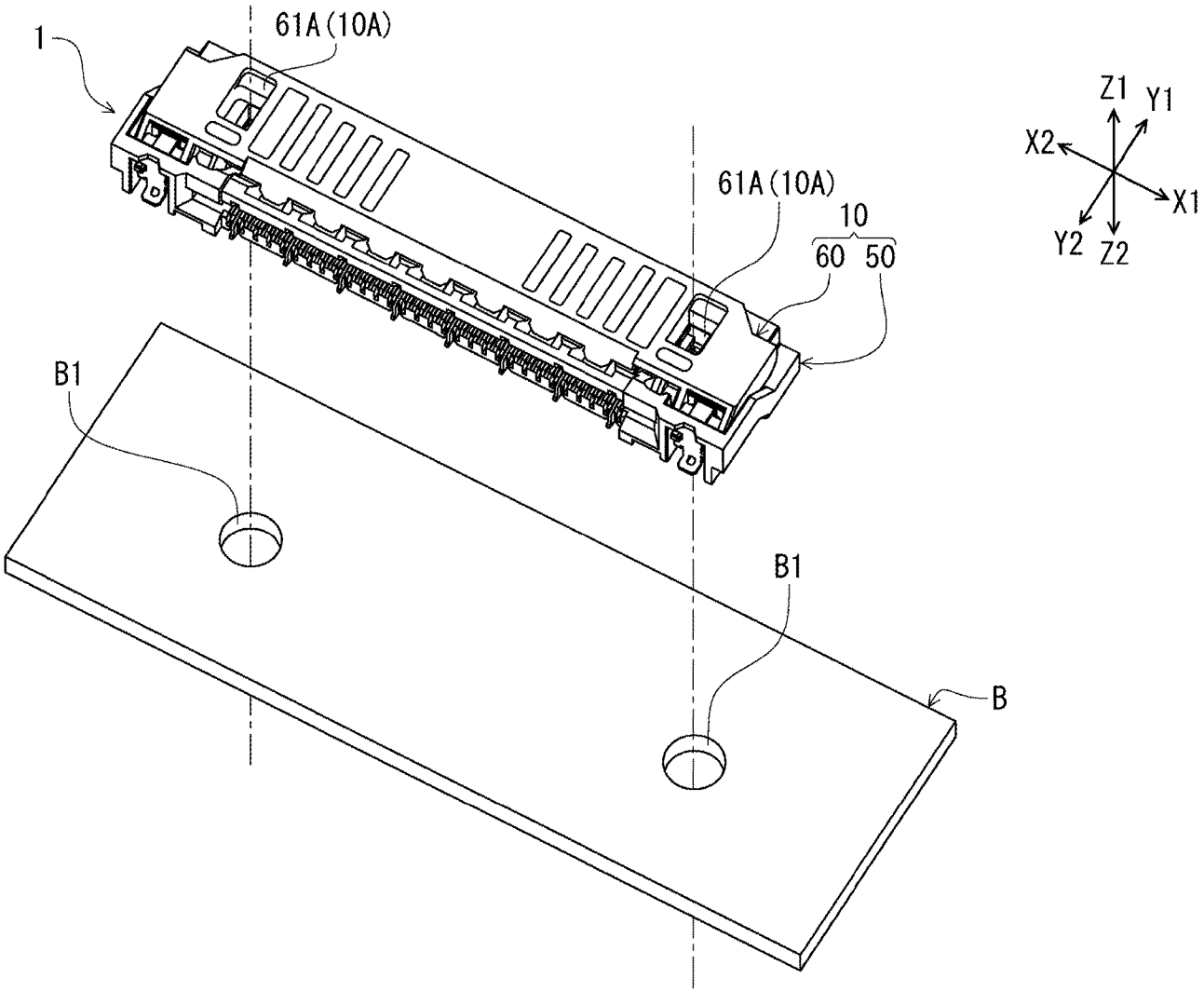
FIG. 3 illustrates a perspective view illustrating the circuit board-mounted electrical connector of FIG. 1 in a state in which the electrical connector is separated from the circuit board.

FIG. 1 and FIG. 2 are perspective views illustrating a circuit board-mounted electrical connector according to an embodiment of the present invention and a flat conductor, wherein FIG. 1 illustrates a state immediately prior to the insertion of the flat conductor and FIG. 2 illustrates a state of complete insertion of the flat conductor. FIG. 3 is a perspective view illustrating the circuit board-mounted electrical connector of FIG. 1 in a state in which the electrical connector is separated from the circuit board. In addition, FIGS. 4(A) and 4(B) illustrates a cross-sectional view illustrating a cross-section of the electrical connector for flat conductors taken in a plane perpendicular to the terminal array direction at the locations of the transmission-permitting portions in the terminal array direction and an insertion state detection device, wherein FIG. 4(A) illustrates the process of flat conductor insertion and FIG. 4(B) illustrates the state of complete insertion of the flat conductor.

The circuit board-mounted electrical connector according to the present embodiment has a circuit board B, and an electrical connector 1 (hereinafter referred to simply as "connector 1"), which is mounted on the mounting face of said circuit board B and to which a flat conductor C serving as a counterpart connector component is removably connected such that a front-to-rear direction parallel to said mounting face (Y-axis direction) is the direction of insertion and extraction. The connector 1 is disposed on the mounting face of the circuit board B and puts the circuit board B in electrical communication with the flat conductor C due to the fact that the flat conductor C is connected thereto.

As can be seen in FIG. 1, the flat conductor C, which has a strip-like configuration extending in the front-to-rear direction, has multiple circuits extending in the front-to-rear direction (not shown) formed in an array in the width direction (X-axis direction) on the bottom face thereof. Said circuits are embedded within the insulating layer of the flat conductor C and extend in the front to rear direction all the way to the front end point of the flat conductor C (end on side Y1). In addition, the front end portion of the flat conductor C, which is inserted into a hereinafter-described receiving portion 51 of the connector 1, has smaller width dimensions than other sections and has notched portions C1 formed in both lateral edges thereof. Ear portions C2, which protrude outwardly in the above-mentioned width direction, are formed at locations forward of said notched portions C1, and the rear end edges of said ear portions C2 serve as engageable portions C2A that engage with hereinafter-described engaging portions 66B of the movable member 60 of the connector 1 (see FIG. 4(B)). In addition, a reinforcing plate C3 is adhered to the top face of the front end portion of the flat conductor C, thereby effecting reinforcement of said front end portion.

The connector 1 is provided with a housing 10 of a substantially rectangular parallelepiped-like outer shape made of an electrically insulating material, multiple metal signal terminals 20 and ground terminals 30 are retained in said housing 10 in array form (referred to collectively as "terminals 20, 30" if there is no need to distinguish between the two) such that the longitudinal direction of said housing 10 is the terminal array direction (X-axis direction), and biasing fittings 40 are retained in place in the housing 10 on both sides outward of the array range of the terminals 20 and 30. Said connector 1 is adapted so that the front end portion of the flat conductor C can be inserted and connected thereto from the rear (side Y2 in FIG. 1). In addition, the above-mentioned housing 10 has a housing main body 50, which retains the terminals 20, 30 in array form, and a movable member 60, which is supported by the housing main body 50 in a manner permitting changeover motion (pivoting) between hereinafter-described closed and open positions.

First, a summary of the insertion and extraction of the flat conductor C into and from the connector 1 will be provided before describing the configuration of the connector 1 in detail. Prior to the insertion of the flat conductor C into the connector 1, in a closed position characterized by the orientation illustrated in FIG. 1, the movable member 60 of the connector 1 permits the insertion of the flat conductor C into the housing main body 50. In addition, as can be seen in FIG. 2, even after inserting and connecting the flat conductor C, when the connector 1 is in use, the movable member 60 is kept in the closed position and, as described hereinafter, the engaging portions 66B of the movable member 60 and the engageable portions C2A of the flat conductor C are positioned in an engageable manner, thereby precluding rearward extraction of the flat conductor C (see FIG. 4(B)).

In addition, when the flat conductor C is extracted, i.e., when the connector 1 is not in use, the movable member 60 pivots and switches to an open position, thereby releasing the engagement of the engaging portions 66B of the movable member 60 with the engageable portions C2A of the flat conductor C. Subsequently, when the flat conductor C is pulled backward, the movable member 60 is acted upon by an abutment force exerted by the engageable portions C2A of the flat conductor C on the pressure-receiving portion 66C of said movable member 60 (see FIGS. 4(A) and 4(B)) and, as a result, pivots toward the closed position while permitting rearward extraction of the flat conductor C in the process of its pivoting. After the extraction of the flat conductor C, the movable member 60, subject to a biasing force exerted by the biasing fittings 40, pivots toward the closed position and automatically arrives at the closed position. In this manner, the extraction of the flat conductor C and the pivoting of the movable member 60 to the closed position are performed as a continuous series of actions.

Going back to the configuration of the connector 1, as can be seen in FIG. 1 and FIG. 2, the housing main body 50 of the housing 10 extends such that the terminal array direction parallel to the mounting face of the circuit board B (X-axis direction) is its longitudinal direction, and a receiving portion 51 used to receive the front end portion of the flat conductor C is formed as a rearwardly open space. Said housing main body 50 has a bottom wall 52 extending in parallel to the above-mentioned mounting face; a top wall 53 extending over a range including the terminal array range in the above-mentioned longitudinal direction, i.e., in the terminal array direction, in opposition to said bottom wall 52; lateral walls 54 located at both ends of the bottom wall 52 and top wall 53 in the terminal array direction; and a front wall 55, which extends over a range including the terminal array range in the terminal array direction and couples the front ends of the bottom wall 52 and top wall 53 (see FIGS. 4(A) and 4(B)).

As can be seen in FIG. 1 and FIG. 2, the previously discussed receiving portion 51 is formed in the terminal array direction within a range corresponding to the front end portion of the flat conductor C, that is, within the terminal array range and ranges adjacent to said terminal array range on both outer sides thereof. Said receiving portion 51 has a rearwardly open aperture portion enclosed by the bottom wall 52, top wall 53, and two lateral walls 54, and is adapted to receive the front end portion of the flat conductor C within a space extending in the front-to-rear direction from the aperture portion to the rear surface of the front wall 55 (see also FIGS. 4(A) and 4(B)).

In addition, as can be seen in FIG. 1, signal terminal holding portions 56 and ground terminal holding portions 57 used to hold and retain in place multiple signal terminals 20 and ground terminals 30 are provided in array form in the housing main body 50 at predetermined intervals in the terminal array direction. The multiple signal terminal holding portions 56 are formed at equally spaced intervals. In addition, the ground terminal holding portions 57 are formed within the array range of the signal terminal holding portions 56 between said signal terminal holding portions 56. The signal terminal holding portions 56 and ground terminal holding portions 57 are formed in a slit-like configuration extending at right angles to the terminal array direction.

As can be seen in FIGS. 4(A) and 4(B), on both outer sides of the terminal array range in the terminal array direction, at locations corresponding to the lateral end portions located on both sides of the front end portion of the flat conductor C (at the ends of the flat conductor C in the width direction), the bottom wall 52 has formed therein bottom openings 52A passing therethrough in the heightwise direction of the connector, i.e., in the vertical direction (Z-axis direction). Roughly the front half of said bottom openings 52A, that is, the section thereof located forwardly of the hereinafter-described engaging portions 66B of the movable member 60 (side Y1), constitutes a portion of the hereinafter-described connector-side transmission-permitting portions 10A, and the other section thereof, i.e., roughly the rear half, constitutes a lower holding portion intended for receiving and holding the pressure-receiving portion 66C of the movable member 60 in the closed position.

In addition, at locations corresponding to the above-described bottom openings 52A on the outer sides of the terminal array range in the terminal array direction, the top wall 53 has spaces formed by cutting out substantially the entire extent thereof in the front-to-rear direction. As can be seen in FIG. 4(A), said spaces are formed as upper holding portions 53A intended for receiving and holding the movable member 60 in the closed position. Said upper holding portions 53A are formed above the receiving portion 51. In addition, the previously discussed bottom openings 52A are formed below the receiving portion 51, and said upper holding portions 53A, receiving portion 51, and bottom openings 52A are in communication with one another.

As can be seen in FIG. 1 and FIG. 2, lateral holding portions 54A, which hold the hereinafter-described pivot shaft portions 64 and biased portions 65 of the movable member 60 and, at the same time, also hold the biasing fittings 40, are formed in the rear half of the lateral walls 54. Said lateral holding portions 54A are rearwardly open within a range covering substantially the entire lateral wall 54 in the vertical direction (range excluding the upper end portion), thereby making it possible to mount the biasing fittings 40 from the rear. Further, as can be seen in FIG. 1 and FIG. 2, the rear portion of said lateral holding portions 54A is upwardly open and adapted to receive the pivot shaft portions 64 and biased portions 65 of the movable member 60 from above.

Rotary support portions (not shown) pivotably supporting the pivot shaft portions 64 of the movable member 60 are formed with concave curved surfaces constituting rotary supporting surfaces on opposed interior wall surfaces where lateral holding portions 54A are formed in opposition to each other in the terminal array direction.

The signal terminals 20 and ground terminals 30 are made by punching from a flat major face of a sheet metal member and are respectively held in the signal terminal holding portions 56 and ground terminal holding portions 57 of the housing 10. As a result, the major faces of all the signal terminals 20 are arranged and retained in place in the housing main body 50 at right angles to the terminal array direction.

The signal terminals 20 have resilient arm portions (not shown) extending along the bottom wall 52 within the signal terminal holding portions 56 and capable of resilient displacement in the vertical direction. Signal contact portions intended for contact with the signal circuits of the flat conductor C are formed as protrusions in said resilient arm portions. In addition, the signal terminals 20 have signal connection portions 21 projecting forwardly outside the housing main body 50 (see FIGS. 4(A) and 4(B)) and are adapted to be solder-connected to the corresponding circuits on the circuit board B with said signal connection portions 21. Said signal terminals 20 are mounted to the housing main body 50 by press-fitting from the front into the signal terminal holding portions 56.

The ground terminals 30 have resilient arm portions (not shown) extending along the bottom wall 52 within the ground terminal holding portions 57 and capable of resilient displacement in the vertical direction. Ground contact portions intended for contact with the ground circuits of the flat conductor C are formed as protrusions in said resilient arm portions. In addition, the ground terminals 30 have ground connection portions 31 projecting rearwardly outside the housing main body 50 (see FIG. 1) and are adapted to be solder-connected to the corresponding circuits on the circuit board B with said ground connection portions 31. Said ground terminals 30 are mounted to the housing main body 50 by press-fitting from the rear into the ground terminal holding portions 57.

The biasing fittings 40 are made by bending substantially band-shaped sheet metal members in the through-thickness direction of said sheet metal members. Said biasing fittings 40 have biasing portions (not shown) biasing the biased portions 65 of the movable member 60 toward the open or closed position in the pivoting direction of said movable member 60. When the movable member 60 is located on the side of the open position relative to a predetermined position serving as a boundary in the pivoting direction, the biased portions 65 are biased toward the open position, and, when it is located on the side of the closed position, the biased portions 65 are biased toward the closed position. Since the biasing fittings 40 do not make up the essence of the present invention, no further discussion of the biasing fittings 40 will be provided.

Next, the configuration of the movable member 60 will be discussed with reference to FIG. 1 and FIG. 4(B), in which it is shown mainly in the closed position. In addition, as far as the pivoting direction of the movable member 60 is concerned, for ease of discussion, if necessary, the direction from the open position to the closed position (clockwise direction in FIGS. 4(A) and 4(B)) will be referred to as the "closing direction," and the direction from the closed position to the open position (counterclockwise direction in FIGS. 4(A) and 4(B)) will be referred to as the "opening direction."

As can be seen in FIG. 1, the movable member 60 has a movable member main body portion 61, which has a plate-like configuration extending such that the terminal array direction is its longitudinal direction, and the hereinafter-described end plate portions 62, linkage portions 63, pivot shaft portions 64, biased portions 65, and projecting portions 66, which are located at both ends of the movable member main body portion 61 in the terminal array direction. In the present embodiment, when in the closed position, the movable member 60 interferes with the top wall 53 of the housing main body 50 and pivoting in the closing direction is obstructed.

Figure 4:
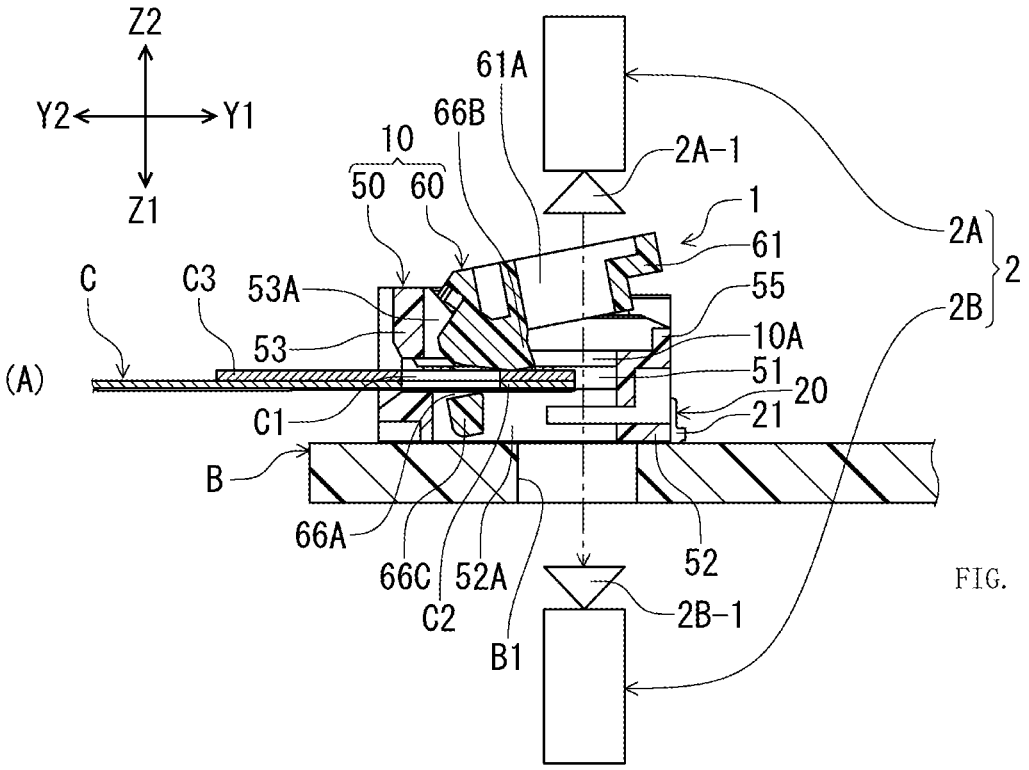
Figure 4:
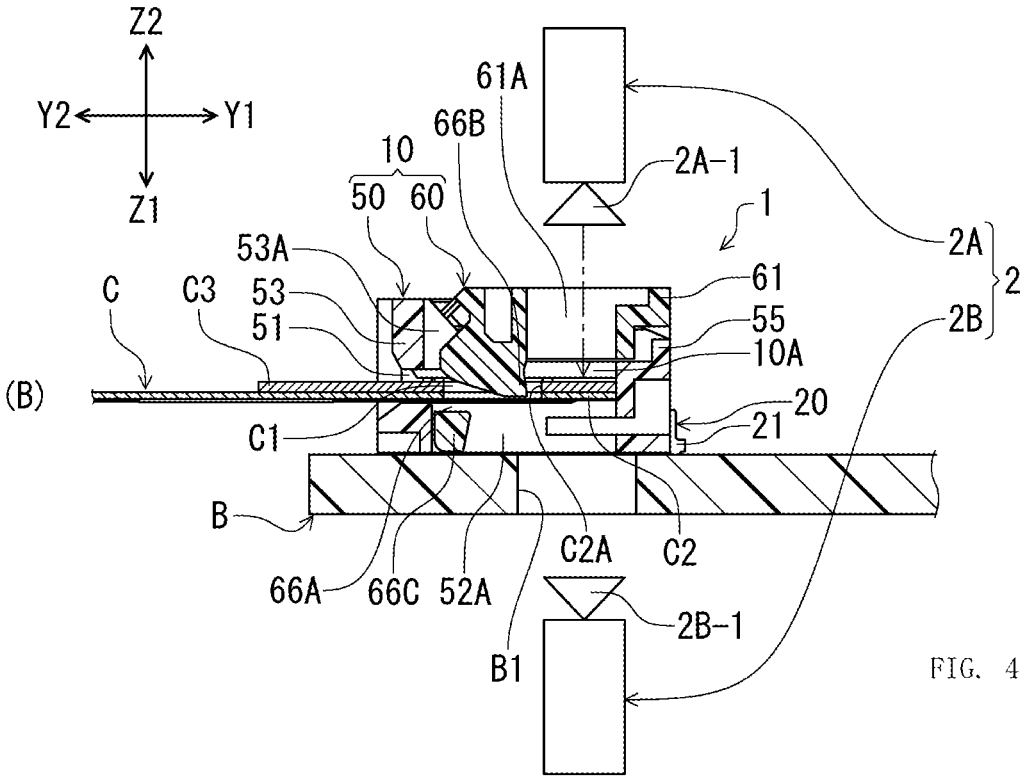

The movable member main body portion 61 is subject to the operation of pivoting of the movable member 60 between the closed and open positions. Upper openings 61A passing through said movable member main body portion 61 in the vertical direction (Z-axis direction) are formed at locations corresponding to the upper holding portions 53A of the housing main body 50 in the terminal array direction. As can be seen in FIG. 4 (B), when the movable member main body portion 61 is in the closed position, said upper openings 61A are positioned in alignment with the front end portion of the receiving portion 51 of the housing main body 50 and roughly the front half of the bottom opening 52A.

In the present embodiment, connector-side transmission-permitting portions 10A passing through the housing 10 in the vertical direction are formed by said upper openings 61A provided in the movable member 60, the front end portion of the above-mentioned receiving portion 51 provided in the housing main body 50, and roughly the front half of the above-mentioned bottom openings 52A provided in said housing main body 50. In other words, the connector-side transmission-permitting portions 10A are formed as a result of the mutual communication of t sections in the upper openings 61A of the movable member 60, the receiving portion 51 of the housing main body 50, and the bottom openings 52A of said housing main body 50 that are positioned in an overlapping manner when viewed in the vertical direction. As described hereinafter, said connector-side transmission-permitting portions 10A are adapted to permit transmission of infrared light serving as wave signals used for detecting the state of insertion of the flat conductor C at the time of insertion of the flat conductor C.

The end plate portions 62 are provided with major faces perpendicular to the terminal array direction at both end points of the movable member main body portion 61 in the terminal array direction. In addition, the linkage portions 63 are provided with major faces perpendicular to the terminal array direction at locations inward of the end plate portions 62 in the terminal array direction and are in face-to-face relationship with the rear ends of the end plate portions 62.

The pivot shaft portions 64 extend in the terminal array direction so as to couple the opposed major faces of the end plate portions 62 and linkage portions 63 at locations corresponding to the lateral holding portions 54A of the housing main body 50 in the terminal array direction. Said pivot shaft portions 64 have a convex curved surface on the peripheral surface about the axes thereof, with the convex curved surfaces at both ends in the terminal array direction pivotably supported by rotary support portions (not shown) provided in the lateral holding portions 54A.

The biased portions 65 engage with biasing portions (not shown) in the biasing fittings 40 and are subject to biasing forces exerted by said biasing portions (not shown) toward the closed or open position. Said biased portions 65 extend downwardly from the center points of the pivot shaft portions 64 in the terminal array direction.

The projecting portions 66, which are provided at inward locations adjacent to the linkage portions 63 in the terminal array direction (see FIG. 1), are formed so as to extend downwardly from the rear portion of the movable member main body portion 61 of said movable member 60. Pass-through groove portions 66A disposed so as to extend in the front-to-rear direction at an intermediate location in the vertical direction when the movable member 60 is in the closed position are formed in said projecting portions 66 by recessing from the inner lateral faces of the projecting portions 66 in the terminal array direction (see FIGS. 4(A) and 4(B)). As described hereinafter, said pass-through groove portions 66A form a space permitting the passage of the engageable portions C2A of the flat conductor C when the movable member 60 is brought into a predetermined angular position (see FIG. 4(A)).

As can be seen in FIG. 4(B), the pass-through groove portions 66A are formed as groove portions that are slightly inclined downward as one moves forward when the movable member 60 is in the closed position. The upper interior wall surface of said pass-through groove portions 66A is inclined gently downward as one moves forward and falls within the thickness range of the flat conductor C in the vertical direction (see FIG. 4(B)). Consequently, in the process of insertion of the flat conductor C, the ear portions C2 of the flat conductor C introduced into the pass-through groove portions 66A abut the upper interior wall surface of the pass-through groove portions 66A and the movable member 60 is pivoted in the opening direction by the abutment force (see FIG. 4(A)).

The sections located directly above the pass-through groove portions 66A in the projecting portions 66 are formed as engaging portions 66B capable of engaging the engageable portions C2A of the flat conductor C acted upon by the rearward extraction force when the movable member 60 is in the closed position.

In addition, the sections located directly below the pass-through groove portions 66A in the projecting portions 66 are formed as pressure-receiving portions 66C capable of abutting the engageable portions C2A of the flat conductor C acted upon by the rearward extraction force when the movable member 60 is in the open position. Regardless of the angular position of the movable member 60, the pressure-receiving portions 66C are located below the pivot shaft portions 64 at all times and are adapted to generate a moment pivoting the movable member 60 in the closing direction about the center of the rotation of the pivot shaft portions 64 when acted upon by the abutment force of the engageable portions C2A.

The circuit board B, on which the connector 1 is mounted, will be discussed next. FIG. 3 is a perspective view illustrating the connector 1 separated from the circuit board B in the vertical direction. Signal circuits (not shown), to which the signal connection portions 21 of the signal terminals 20 are connected, are formed at locations corresponding to said signal connection portions 21, and ground circuits (not shown), to which the ground connection portions 31 of the ground terminals 30 are connected, are formed at locations corresponding to said ground connection portions 31 on the mounting face (top face) of the circuit board B.

As can be seen in FIG. 3, board-side transmission-permitting portions B1 in the form of round openings passing through the circuit board B in the vertical direction (through-thickness direction) are formed in said circuit board B at locations corresponding to the connector-side transmission-permitting portions 10A of the connector 1. Said board-side transmission-permitting portions B1 are formed so as to be larger than said connector-side transmission-permitting portions 10A within a range that includes the connector-side transmission-permitting portions 10A when viewed in the vertical direction (connector-height direction) in the state when the connector 1 is mounted on the circuit board B (see FIGS. 4(A) and 4(B)). In this manner, said board-side transmission-permitting portions B1 are located directly below the connector-side transmission-permitting portions 10A and are in communication with said connector-side transmission-permitting portions 10A and, as described hereinafter, are adapted to permit the transmission of infrared light serving as wave signals used for detecting the state of insertion of the flat conductor C at the time of insertion of the flat conductor C.

In the present embodiment, when the flat conductor C is inserted from the rear and connected to the connector 1 mounted on the circuit board B, i.e., to the circuit board-mounted connector, the hereinafter-described insertion state detection device 2 (see FIGS. 4(A) and 4(B)) is adapted to detect whether the flat conductor C has been inserted all the way to the normal insertion position. As can be seen in FIGS. 4(A) and 4(B), the insertion state detection device 2 has a light-projecting device 2A, which is located directly above the connector-side transmission-permitting portions 10A of the connector 1 and projects infrared light used as wave signals, a light-receiving device 2B, which is located directly below the board-side transmission-permitting portions B1 of the circuit board B and receives infrared light from the light-projecting device 2A, and a notification device connected to said light-receiving device 2B (not shown). The light-projecting device 2A is disposed such that its light-projecting portion 2A-1 faces downward. In addition, the light-receiving device 2B is disposed such that its light receiving portion 2B-1 faces upward. The above-mentioned notification device is a device intended for notifying an operator of the presence or absence of light reception by the light-receiving device 2B, for example, by providing notifications of the presence or absence of light reception by displaying on a monitor or using flashing lamps, or the like.

Although in the present embodiment the light-projecting device 2A of the insertion state detection device 2 is positioned at the top and the light-receiving device 2B is located at the bottom, as an alternative, the light-projecting device 2A may be located at the bottom and the light-receiving device 2B may be located at the top. In addition, while the light-projecting device 2A and the light-receiving device 2B are provided in alignment with the transmission-permitting portions (connector-side transmission-permitting portions 10A and board-side transmission-permitting portions B1) located on both or one side of the circuit board-mounted connector, the state of insertion of the flat conductor C can be detected in a more reliable manner when they are provided in alignment with the transmission-permitting portions on both sides.

In the present embodiment, as described hereinafter, the ear portions C2 of the flat conductor C are adapted to be positioned at the locations of the transmission-permitting portions when said flat conductor C is inserted all the way to the normal insertion position within the receiving portion 51 of the connector 1 (see FIG. 4(A)). As a result, transmission of infrared light from the light-projecting portion 2A-1 of the light-projecting device 2A is blocked by the ear portions C2, and no infrared light is received in the light-receiving portion 2B-1 of the light-receiving device 2B, as a result of which it is detected that the flat conductor C has been inserted all the way to the normal position.

Next, the operations of insertion of the circuit board-mounted connector and the flat conductor C and the operation of insertion state confirmation will be discussed with reference to FIG. 1, FIG. 2, and FIGS. 4(A) and 4(B). First, a circuit board-mounted electrical connector is configured by solder-connecting the signal connection portions 21 of the signal terminals 20 of the connector 1 and the ground connection portions 31 of the ground terminals 30 to the corresponding circuits of the circuit board. In said circuit board-mounted electrical connector, the connector-side transmission-permitting portions 10A of the connector 1 and the board-side transmission-permitting portions B1 of the circuit board B are positioned at the same location when viewed in the vertical direction.

Next, said circuit board-mounted connector is disposed such that the transmission-permitting portions of the circuit board-mounted connector, i.e., the connector-side transmission-permitting portions 10A and the board-side transmission-permitting portions B1 of the circuit board B, are positioned in alignment with the light-projecting device 2A and the light-receiving device 2B (see the position depicted in FIGS. 4(A) and 4(B)). At this point in time (prior to the insertion of the flat conductor C), the infrared light projected from the light-projecting device 2A is transmitted downwardly through the connector-side transmission-permitting portions 10A and the board-side transmission-permitting portions B1 and is received by the light-receiving device 2B.

Next, after positioning the flat conductor C behind the connector 1 such that it extends along the mounting face of the circuit board (not shown) in a front-to-rear direction (see FIG. 1), the flat conductor C is inserted forwardly (toward side X1) into the receiving portion 51 of the connector 1. In the process of insertion of the flat conductor C into the receiving portion 51, the bottom face of the flat conductor C abuts the respective contact portions (not shown) of the terminals 20, 30 and the respective resilient arm portions (not shown) of said terminals 20, 30 are resiliently displaced downward.

In addition, once the ear portions C2 located in proximity to both lateral ends of the flat conductor C have been introduced into the pass-through grooves 66A of the movable member 60, the front ends of said ear portions C2 abut the upper interior wall surface of said pass-through groove portions 66A and the abutment force pivots the movable member 60 in the opening direction. As a result, as can be seen in FIG. 4(A), with the ear portions C2 supporting the upper interior wall surface of the pass-through groove portions 66A from below, the rotation angle of the movable member 60 in the process of insertion of the flat conductor C is increased to the maximum. In addition, as can be seen in FIG. 4(A), at this point in time, a clearance equal to or greater than the thickness of the flat conductor C is formed throughout the entire extent of the pass-through groove portions 66A in the front-to-rear direction, thereby permitting further forward progress of the ear portions C2 and, consequently, the flat conductor C.

In addition, as can be seen in FIG. 4(A), despite the fact that at this point in time a portion of the ear portions C2 of the flat conductor C has been introduced into the connector-side transmission-permitting portions 10A from the rear, it has not yet reached the rays of projected infrared light (one-dot chain line in FIG. 4(A)). Consequently, the infrared light projected from the light-projecting device 2A is transmitted through the connector-side transmission-permitting portions 10A and the board-side transmission-permitting portions B1, thereby maintaining the state of light reception by the light-receiving device 2B.

As can be seen in FIG. 4(B), when the flat conductor C is inserted farther, the front end of said flat conductor C abuts the rear surface of the front wall 55 and said flat conductor C is brought into the normal insertion position (position of complete insertion) (see also FIG. 2). Once the flat conductor C has been completely inserted, the state of resilient displacement of the resilient arm portions of the terminals 20, 30 is maintained and the circuits (not shown) on the bottom face of the flat conductor C are brought into contact with the contact portions (not shown) of the terminals 20, 30 under contact pressure and a state of electrical communication therewith is maintained. This completes the operation of insertion of the flat conductor C.

In addition, as can be seen in FIG. 4(B), when the flat conductor C is brought into the position of complete insertion, the ear portions C2 of the flat conductor C pass through the locations of the engaging portions 66B and are brought forwardly of said engaging portions 66B. As a result, acted upon by the biasing force of the biasing portions of the biasing fittings 40, the movable member 60 goes back to the closed position and, as can be seen in FIG. 4(B), the engaging portions 66B protrude into the notched portions C1 of the flat conductor C from above. In addition, the engageable portions C2A of the flat conductor C are positioned in a manner permitting engagement with the engaging portions 66B from the front, thereby preventing rearward extraction of the flat conductor C.

In addition, as can be seen in FIG. 4(B), in the position of complete insertion, the infrared light that has been received until then by the light-receiving device 2B is no longer received because the ear portions C2 are located entirely within the connector-side transmission-permitting portions 10A and the transmission of infrared light from the light-projecting device 2A is blocked by said ear portions C2. As a result, a notification to the effect that the insertion of the flat conductor C has been successfully completed is displayed on a monitor (not shown) serving as a notification device, and, by looking at the monitor, an operator can confirm that the flat conductor C has been inserted all the way to the normal insertion position.

On the other hand, if the flat conductor C has not been brought into the normal position even though said flat conductor C has been inserted, said ear portions C2 do not reach the rays of infrared light projected in the connector-side transmission-permitting portions 10A, the transmission of infrared light is still permitted, and reception of infrared light by the light-receiving device 2B is maintained. Consequently, no notifications to the effect that that the insertion of the flat conductor C has been completed are displayed on the monitor (not shown) serving as the notification device. As a result, by looking at the monitor, the operator can confirm that the flat conductor C has not been inserted all the way to the normal insertion position and can address this problem by re-inserting the flat conductor C.

In the present embodiment, when the connector 1 is mounted on the mounting face of the circuit board B, the connector-side transmission-permitting portions 10A formed in the housing 10 of the connector 1 and the board-side transmission-permitting portions B1 formed in the circuit board B are positioned in alignment with each other and the infrared light projected from the light-projecting device 2A is transmitted through the transmission-permitting portions and received (detected) by the light-receiving device 2B, thereby making it possible to determine whether the flat conductor C has been inserted all the way to the normal position. As a result, the operator no longer needs to confirm the state of insertion of the flat conductor by looking at each individual connector, as was conventionally done, and the state of insertion of the flat conductor can be confirmed in an extremely easy manner. In addition, the accuracy of the results of insertion state confirmation can be improved because visual observation is not performed from a slanted vantage point, as could be the case in the past.

Usually, when the flat conductor C was in a tilted orientation within the receiving portion 51, in which the front end edge of said flat conductor C ended up with a relative offset in the front-to-rear direction at the two ends of said flat conductor C in the width direction, the amount of offset of the end portions relative to the normal orientation (non-inclined orientation) in the front-to-rear direction was larger in comparison with the intermediate portion in the above-mentioned width direction. Since in the present embodiment the connector-side transmission-permitting portions 10A and the board-side transmission-permitting portions B1 are formed at locations corresponding to the ends of the flat conductor C in the width direction, it is easy to detect that the flat conductor C has not been inserted all the way to the normal position. However, forming the transmission-permitting portions at the ends of the flat conductor in the width direction is not essential, and, if sufficient accuracy of insertion state detection can be ensured, the transmission-permitting portions may be formed in the intermediate portion of the flat conductor in the width direction. In any case, the connector-side transmission-permitting portions need to be formed within the range of the receiving portion of the housing in a plane parallel to the mounting face of the circuit board.

In addition, in the present embodiment, the board-side transmission-permitting portions B1 may be made larger than said connector-side transmission-permitting portions 10A when viewed in the connector-height direction in a range that includes the connector-side transmission-permitting portions 10A. Doing so would ensure the infrared light projected from above, i.e., from the connector-side transmission-permitting portions 10A, is not blocked by the circuit board B and, for this reason, said infrared light could also be transmitted more reliably through the board-side transmission-permitting portions B1.

Although in the present embodiment the ear portions C2 are adapted to be at the locations of the transmission-permitting portions when the flat conductor C reaches the normal position, as an alternative, the ear portions may be adapted such that the ear portions are present at the locations of the transmission-permitting portions immediately prior to the moment when the flat conductor reaches the normal position, and, once the normal position has been reached, the ear portions are no longer present at the locations of the transmission-permitting portions. In such a configuration, in the above-mentioned normal position, the transmission-permitting portions are located rearwardly of the above-mentioned ear portions. When the flat conductor is brought into the normal position, the transmission of infrared light previously blocked by the ear portions is permitted and the transmitted infrared light is detected by the light-receiving device. On the other hand, when said flat conductor is not in the normal position even though the flat conductor has been inserted, no infrared light is detected by the light-receiving device because said flat conductor is present at the locations of the transmission-permitting portions and the transmission of infrared light remains blocked by said flat conductor.

Although in the present embodiment the counterpart connector component connected to the connector 1 is a flat conductor, the counterpart connector component is not limited thereto and may be, for example, an electrical connector. If the counterpart connector component is an electrical connector, then, for example, openings may be formed passing through said electrical connector in the connector-height direction and, once the connectors are mated, it becomes possible to detect whether the mating of the connectors is complete depending on whether said openings are in the same locations as the transmission-permitting portions. In addition, notched portions extending throughout the entire extent in the connector-height direction may be formed instead of the above-mentioned openings.

Although the present embodiment has described an embodiment using infrared light as the transmitted signals, the transmitted signals that can be used are not limited thereto, and it is possible to use any signals whose transmission might be impeded by insulating resin materials, for example, UV light, visible light, and other optical signals, as well as ultrasonic waves and other acoustic wave signals. In particular, the use of signals that propagate in a highly linear manner is preferable because this permits the wave signals to be readily transmitted through the transmission-permitting portions.

In addition, although in the present embodiment the insertion state detection device has a light-projecting device and a light-receiving device, the configuration of the insertion state detection device is not limited thereto. For example, if the wave signal is visible light, the insertion state detection device may consist of a light-projecting device that projects visible light and a reflective plate that reflects the projected visible light. If such a configuration is used, then, for example, visible light projected from the light-projecting device and transmitted through the light-transmission-permitting portions can be reflected in a direction different from the direction of light projection with the help of a reflective plate (for example, a mirror, or the like) and the operator can visually observe this reflected light.

Although in the present embodiment the transmission-permitting portions are formed as openings, the configuration of the transmission-permitting portions is not limited thereto and, for example, the sections constituting the connector-side transmission-permitting portions in the housing and the sections constituting the board-side transmission-permitting portions in the circuit board may be formed from transparent materials that permit the transmission of wave signals.

DESCRIPTION OF THE REFERENCE NUMERALS

1 Connector
10 Housing
10A Connector-side transmission-permitting portions
20 Signal terminals
21 Signal connection portions
30 Ground terminals
31 Ground connection portions
B Circuit board
B1 Board-side transmission-permitting portions
C Flat conductor (counterpart connector component)
C2 Ear portions

What is claimed is:

1. A circuit board-mounted electrical connector comprising:

a circuit board and an electrical connector which is mounted on a mounting face of said circuit board and to which a counterpart connector component is removably connected such that a front-to-rear direction parallel to said mounting face is a direction of insertion and extraction;

wherein the electrical connector comprises:

a housing which has formed therein a receiving portion that receives, from the rear, the counterpart connector component whose width direction is a direction parallel to the mounting face and perpendicular to the front-to-rear direction, and terminals, which are retained in place in said housing and which have formed therein contact portions contacting the counterpart connector component inserted into the receiving portion and also have formed therein connection portions connected to the mounting face of the circuit board;

wherein, within a range of the receiving portion in a plane parallel to the mounting face, the housing further comprises connector-side transmission-permitting portions that permit the transmission of wave signals in the connector-height direction perpendicular to the mounting face;

the circuit board comprises board-side transmission-permitting portions that permit the transmission of wave signals in the connector-height direction at locations corresponding to the connector-side transmission-permitting portions when the electrical connector is mounted; and, when the counterpart connector component is inserted all the way to a normal position, the transmission of wave signals permitted in the process of insertion of the counterpart connector component becomes blocked by the counterpart connector component, or alternatively, the transmission of wave signals blocked by said counterpart connector component in the process of insertion of the counterpart connector component becomes permissible at the locations of the connector-side transmission-permitting portions and the board-side transmission-permitting portions.

2. The circuit board-mounted electrical connector according to claim 1, wherein the connector-side transmission-permitting portions are formed as openings passing through the housing in the connector-height direction, and the board-side transmission-permitting portions are formed as openings passing through the circuit board in the connector-height direction.

3. The circuit board-mounted electrical connector according to claim 1, wherein the connector-side transmission-permitting portions and the board-side transmission-permitting portions are formed at locations corresponding to the ends of the counterpart connector component in the width direction.

4. The circuit board-mounted electrical connector according to claim 3, wherein, in a state in which a flat conductor serving as the counterpart connector component, which has formed therein ear portions protruding in the width direction, has been inserted all the way to the normal position, the connector-side transmission-permitting portions and the board-side transmission-permitting portions are formed to be at the same locations as the ear portions, or alternatively, are formed to be at locations to the rear of said ear portions.

5. The circuit board-mounted electrical connector according to claim 1, wherein the board-side transmission-permitting portions are made larger than the connector-side transmission-permitting portions when viewed in the connector-height direction in a range that includes said connector-side transmission-permitting portions.

* * * * *